United States Patent [19]

Gaskell

[11] Patent Number: 4,917,306

[45] Date of Patent: Apr. 17, 1990

[54] FUEL INJECTION NOZZLE

[75] Inventor: David J. Gaskell, Sudbury, England

[73] Assignee: Lucas Industries Public Limited Company, Birmingham, England

[21] Appl. No.: 152,655

[22] Filed: Feb. 5, 1988

[30] Foreign Application Priority Data

Feb. 6, 1987 [GB] United Kingdom ..... 8702711

[51] Int. Cl.[4] ..... F02M 47/00

[52] U.S. Cl. ..... 239/533.9; 239/533.6

[58] Field of Search ..... 239/533.2, 533.6, 533.9, 239/533.1, 533.3, 533.11, 533.12; 137/469, 474, 475

[56] References Cited

U.S. PATENT DOCUMENTS

| | | | |
|---|---|---|---|
| 1,735,718 | 11/1929 | Attendu | 239/533.6 |
| 3,373,943 | 3/1968 | Roosa | 239/533.11 |
| 4,096,999 | 6/1978 | Eckert et al. | 239/533.5 |
| 4,591,100 | 5/1986 | Gaskell et al. | 239/533.3 |
| 4,836,454 | 6/1989 | Gaskell | 239/533.9 |

FOREIGN PATENT DOCUMENTS

| | | |
|---|---|---|
| 2711393 | 9/1978 | Fed. Rep. of Germany . |
| 2333973 | 12/1976 | France . |
| 60-8465 | 1/1985 | Japan . |

*Primary Examiner*—Andres Kashnikow
*Assistant Examiner*—C. Trainor
*Attorney, Agent, or Firm*—Balogh, Osann, Kramer, Dvorak, Genova & Traub

[57] ABSTRACT

A fuel injection nozzle comprises a valve member which is biased into contact with a seating by a spring supported on a spring abutment having an integral extension which projects through an aperture in the end face of a holder which carries a nozzle body in which the valve member is located. The valve member is in engagement with the extension. A sleeve surrounds the valve member and is slidable in the body and is engageable with the extension. The valve member and the sleeve move together against the action of the spring under the action of fuel pressure to allow fuel flow to an outlet. The movement of the sleeve is arrested by a stop surface defined by the end face of the holder. The continued movement of the valve member being under the action of the fuel pressure acting on the valve member alone, until its movement is arrested by a stop.

4 Claims, 1 Drawing Sheet

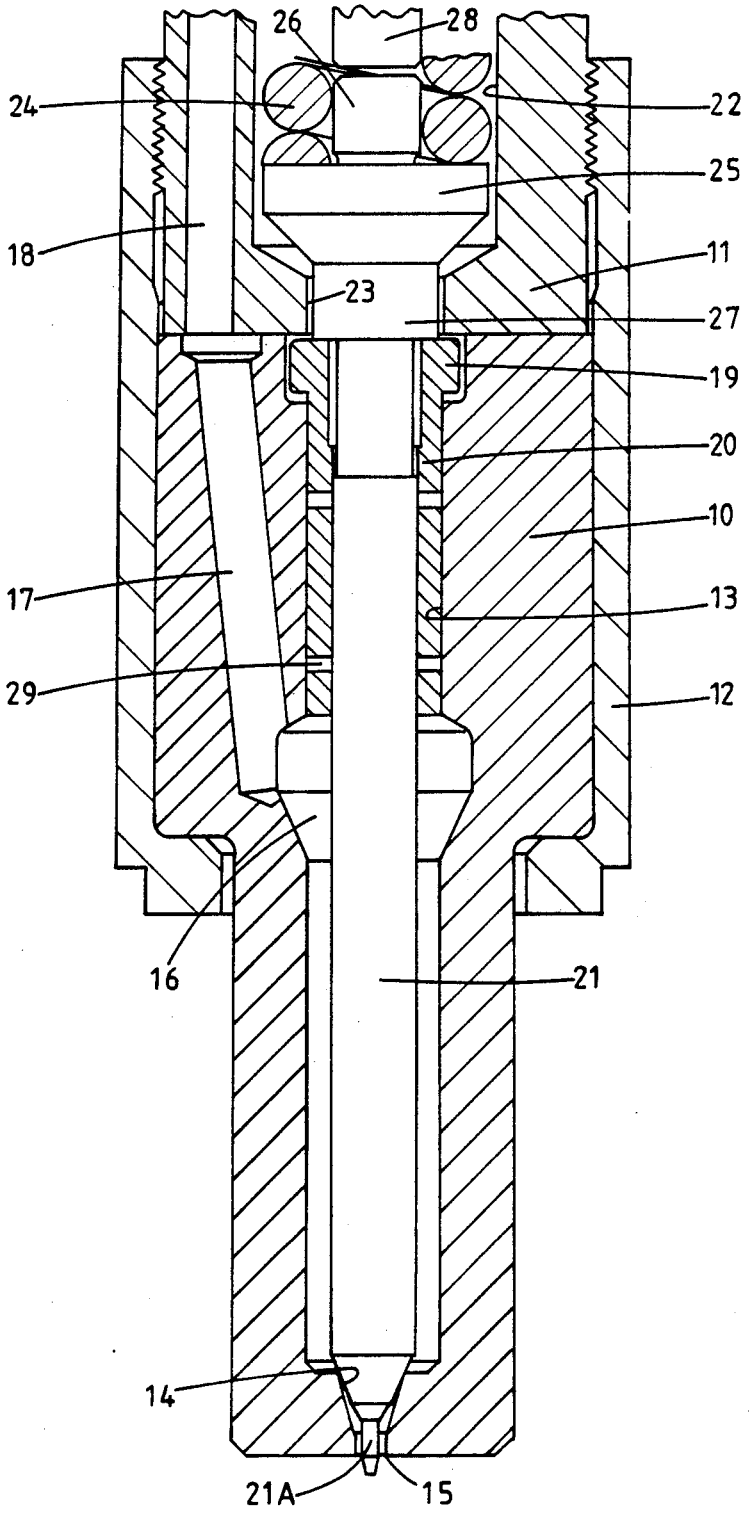
26
28
24
22
25
18
11
23
27
19
20
10
17
13
29
12
16
21
14
21A
15

FUEL INJECTION NOZZLE

This invention relates to a fuel injection nozzle for supplying fuel to a an internal combustion engine and of the kind comprising a valve member which is movable axially by fuel under pressure supplied through a nozzle inlet, away from a seating to permit fuel flow from the inlet to an outlet, the valve member being slidable within a sleeve which is itself axially slidable in a bore in a nozzle body and subjected to the fuel pressure at said inlet, a spring biasing the valve member into contact with the seating, the fuel pressure acting on the sleeve serving to oppose the action of the spring, first stop means for limiting the extent of movement of the sleeve and second stop means for limiting the extent of movement of the valve member.

The object of the invention is to provide a fuel injection nozzle of the kind specified in a simple and convenient form.

According to the invention a fuel injection nozzle of the kind specified comprises a holder, means securing the nozzle body to the holder, said first stop means being defined by part of the end surface of the holder to which the nozzle body is secured, an opening formed in said end surface, said opening extending into a chamber formed in the holder, said spring being located in the chamber and engaging a spring abutment which extends through said opening for engagement by said valve member and said sleeve and an adjustable stop member extending within said chamber for engagement by said abutment, said stop member forming said second stop means.

BRIEF DESCRIPTION OF THE DRAWING

An example of a fuel injection nozzle in accordance with the invention will now be described with reference to the accompanying drawing which shows in sectional side elevation, part of the nozzle.

Referring to the drawing there is provided a nozzle body 10 of stepped cylindrical form and which is secured to the end surface of a cylindrical nozzle holder 11 by means of the conventional form of cap nut 12.

Formed in the nozzle body 10 is a bore 13 which extends from the end surface of the body presented to the holder, to adjacent the end of the narrower portion of the body. At this end of the bore there is defined a seating 14 which surrounds an outlet 15. Intermediate the ends of the bore there is formed an enlargement 16 into which extends a passage 17 which communicates with a further passage 18 which is formed in the holder and which extends to a fuel inlet, the fuel inlet in use being connected to the outlet of a high pressure fuel injection pump not shown.

The end portion of the bore adjacent the holder is of slightly larger diameter to accommodate a flange 19 formed on a sleeve member 20 slidable within the bore. Moreover, slidable within the sleeve is a valve member 21 which, in the particular example, is of substantially uniform diameter throughout its length. The valve member is shaped for co-operation with the seating 14 and it has an extension 21A which extends through the outlet 15. In the closed position of the valve member as shown, a small clearance exists between the end of the valve member adjacent the holder and the adjacent end surface of the body.

Formed within the holder is a chamber 22 which has a reduced opening 23 onto the end surface of the holder against which the nozzle body is secured. Located within the chamber is a coiled compression spring 24 one end of which is supported on a spring abutment 25 which has an integral peg 26 extending within the coils of the spring and an integral extension 27 which extends within the opening 23 for engagement by the end of the valve member 21 and also the flange 19 of the sleeve. The opposite end of the spring is mounted conveniently in an adjustable spring abutment whereby the force exerted by the spring on the valve member can be adjusted and extending within the spring into close proximity to the peg 26 is an adjustable stop member 28.

In operation when fuel under pressure is supplied to the enlargement 16 the fuel pressure acts upon the end surface of the sleeve and also upon the differential surface of the valve member to produce forces which oppose the action of the spring 24. When the forces generated by the fuel pressure overcome the force exerted by the spring, the sleeve and valve member lift by an amount determined by the distance between the upper face of the flange 19 and the end face of the holder 11. This movement will raise the valve member from the seating to permit fuel flow through the outlet 15, the extension 21A and the gap between the valve member and the seating acting in known manner to control the flow of fuel. Further movement of the valve member will not take place until the fuel pressure has risen sufficiently so that the force acting on the valve member alone overcome the force exerted by the spring and when this occurs the valve member will lift to allow substantially unrestricted flow of fuel through the outlet 15. The extent of additional movement of the valve member is determined by the abutment of the peg 26 with the stop member 28. When the pressure of fuel falls the valve member and the sleeve will be returned to their original positions under the action of the spring 24 and the sleeve will be prevented from falling into the enlargement 16 by the abutment of the flange 19 with the step defined in the bore 13. The sleeve is provided with transverse openings 29 so as to equalize, so far as is possible, the pressures in the working clearances between the sleeve and the wall of the bore 13 and between the sleeve and the surface of the valve member. In addition, the end portion of the valve member adjacent the abutment is relieved as also is, in the particular example, the bore in the sleeve, to minimize the risk of jamming of the two components by the forces exerted during operation of the nozzle.

The initial lift of the valve member must be closely controlled since this has a bearing on the rate of fuel flow to the associated engine during the initial portion of fuel delivery. The adjustment is effected by controlling the amount by which the end surface of the valve member is recessed below the end surface of the body 10 when the valve member is in the closed position. The total movement of the valve member is of course determined by the position of the stop member 28.

Although the example illustrates a so-called "pintle" nozzle it will be understood that the construction as described can be applied to a so-called "hole" type nozzle. In this case the initial movement of the valve member results in the formation of a limited clearance between the valve member and the seating which clearance provides a restricted flow path for the fuel to provide the required restriction to the flow of fuel to the engine.

I claim:

1. A fuel injection nozzle for supplying fuel to an internal combustion engine, comprising a nozzle holder having an end face, a nozzle body, means for securing said nozzle body to said end face, a bore formed in said nozzle body, a seat located at one end of said bore, a sleeve slidable axially in the bore, a valve member having a first end and a second end and being slidable axially within said sleeve and shaped at said first end for cooperation with said seat, a chamber located in said holder, a spring located within said chamber, an abutment which engages said spring at one end, and extends through a reduced opening in said nozzle holder to engage said valve member at said second end, a surface defined on said valve member, passage means for conveying pressurized fuel from an inlet to said surface, a first end surface of said sleeve, a second end surface of said sleeve located opposite said first end surface, said second end surface being engageable with said abutment, said valve member surface being acted upon by fuel pressure which also acts on said first end surface of said sleeve to oppose the action of said spring, whereas at a sufficient fuel pressure level said sleeve and valve member move together away from said seating thereby permitting fuel flow from said inlet to an outlet, engagement of said second end surface of said sleeve with said end face of said holder serving to arrest sleeve movement, and an adjustable stop member located in said chamber for engaging said abutment thereby limiting further valve member movement after arrestment of sleeve movement, and wherein said valve member has a reduced outside diameter at said second end, said reduced diameter having an extended relationship with said sleeve member to thereby minimize risk of jamming of said sleeve member and said valve member.

2. A fuel injection nozzle according to claim 1, in which said sleeve has a second end face in the form of an outwardly extending enlarged flange, said bore having an enlarged section which accommodates said flange, whereby said flange engages said nozzle body thereby limiting movement of said sleeve away from said end face of said holder.

3. A fuel injection nozzle for supplying fuel to an internal combustion engine, comprising a nozzle holder having an end face, a nozzle body, means for securing said nozzle body to said end face, bore formed in said nozzle body, a seat located at one end of said bore, a sleeve slidable axially in the bore, a valve member having a first end and a second end and being slidable axially within said sleeve and shaped at said first end for cooperation with said seat, a chamber located in said holder, a spring located within said chamber, an abutment which engages said spring at one end, and extends through a reduced opening in said nozzle holder to engage said valve member at said second end, a surface defined on said valve member, passage means for conveying pressurized fuel from an inlet to said surface, a first end surface of said sleeve, a second end surface of said sleeve located opposite said first end surface, said second end surface being engageable with said abutment, said valve member surface being acted upon by fuel pressure which also acts or said first end surface of said sleeve to oppose the action of said spring, whereas at a sufficient fuel pressure level said sleeve and valve member move together away from said seating thereby permitting fuel flow from said inlet to an outlet, engagement of said second end surface of said sleeve with said end face of said holder serving to arrest sleeve movement, and an adjustable stop member located in said chamber for engaging said abutment thereby limiting further valve movement after arrestment to sleeve movement, and wherein said valve member has a reduced outside diameter at said second end, and said sleeve member has an increased inside diameter bore extending from said second end surface, said inside diameter bore being disposed in predetermined relationship to the reduced outside diameter of said valve member to thereby minimize risk of jamming of the sleeve member and the valve member.

4. A fuel injection nozzle according to claim 3, in which said sleeve has a second end face in the form of an outwardly extending enlarged flange, said bore having an enlarged section which accommodates said flange, whereby said flange engages said nozzle body thereby limiting movement of said sleeve away from said end face of said holder.

* * * * *